US008662710B2

(12) United States Patent
Sato et al.

(10) Patent No.: US 8,662,710 B2
(45) Date of Patent: Mar. 4, 2014

(54) ILLUMINATION DEVICE

(75) Inventors: Eiichi Sato, Hachioji (JP); Norio Fukuoka, Hachioji (JP)

(73) Assignee: Opto Design, Inc. (JP)

( * ) Notice: Subject to any disclaimer, the term of this patent is extended or adjusted under 35 U.S.C. 154(b) by 0 days.

(21) Appl. No.: 13/703,591

(22) PCT Filed: Jun. 21, 2011

(86) PCT No.: PCT/JP2011/064164

§ 371 (c)(1),
(2), (4) Date: Dec. 11, 2012

(87) PCT Pub. No.: WO2011/162258

PCT Pub. Date: Dec. 29, 2011

(65) Prior Publication Data

US 2013/0094216 A1 Apr. 18, 2013

(30) Foreign Application Priority Data

Jun. 25, 2010 (JP) ..... 2010-145633

(51) Int. Cl.
*F21V 7/00* (2006.01)

(52) U.S. Cl.
USPC ..... 362/298; 362/297

(58) Field of Classification Search
USPC ..... 362/297, 311.01, 311.02, 311.03, 298, 362/300, 301; 257/98, 99; 40/582
See application file for complete search history.

(56) References Cited

U.S. PATENT DOCUMENTS 7,654,689 B2 * 2/2010 Chang ..... 362/248
8,272,772 B2 9/2012 Sato et al.
2005/0280756 A1 12/2005 Kim et al.
2008/0094842 A1 * 4/2008 King et al. ..... 362/297
2008/0225512 A1 * 9/2008 Roberts et al. ..... 362/97

(Continued)

FOREIGN PATENT DOCUMENTS

CN 101978210 A 2/2011
EP 2261551 A1 12/2010

(Continued)

OTHER PUBLICATIONS

"International Application Serial No. PCT/JP2011/064164, International Preliminary Report on Patentability dated Jan. 15, 2013", (w/ English Translation), 8 pgs.

(Continued)

*Primary Examiner* — Mariceli Santiago
*Assistant Examiner* — Glenn Zimmerman
(74) *Attorney, Agent, or Firm* — Schwegman, Lundberg & Woesnner, P.A.

(57) ABSTRACT

An illumination device includes: a point light source; a substrate; a hollow frame having an engaging bent section at one of its edges; and a bottom surface reflection section, a side surface reflection section, and a light conducting reflection plate that are disposed inside the frame. The light conducting reflection plate is held between the bent section and the side surface reflection section that is held by the other edge of the frame and the bottom surface reflection section fixed to the substrate. The surface of the bottom surface reflection section facing the light conducting reflection plate, the inner surface of the side surface reflection section, and the surface of the light conducting reflection plate facing the bottom surface reflection section have high light reflectivity and low light transmissivity.

14 Claims, 11 Drawing Sheets

(56) References Cited

U.S. PATENT DOCUMENTS

| | | | | |
|---|---|---|---|---|
| 2008/0253129 | A1* | 10/2008 | Lin et al. | 362/295 |
| 2010/0061096 | A1* | 3/2010 | Sato | 362/235 |
| 2011/0018012 | A1 | 1/2011 | Tanaka et al. | |
| 2012/0218752 | A1* | 8/2012 | Sumitani | 362/235 |

FOREIGN PATENT DOCUMENTS

| | | | |
|---|---|---|---|
| JP | 2006-012818 | A | 1/2006 |
| JP | 2009-004248 | A | 1/2009 |
| JP | 2009-016093 | A | 1/2009 |
| JP | 2009-231128 | A | 10/2009 |
| JP | 2010-153370 | A | 7/2010 |
| JP | 2010-192301 | A | 9/2010 |
| KR | 10-2010-0124839 | A | 11/2010 |
| WO | WO-2009/119550 | A1 | 10/2009 |

OTHER PUBLICATIONS

"International Application Serial No. PCT/JP2011/064164, International Search Report mailed Oct. 4, 2011", (EnglishTranslation), 2 pgs.

"International Application Serial No. PCT/JP2011/064164, Written Opinion mailed Oct. 4, 2011", (w/ English Translation), 6 pgs.

"International Application Serial No. PCT/JP2011/064164, International Search Report mailed Oct. 4, 2011", (English Translation), 2 pgs.

* cited by examiner

ILLUMINATION DEVICE

RELATED APPLICATIONS

This application is a nationalization under 35 U.S.C. 371 of PCT/JP2011/064164, filed Jun. 21, 2011, and published as WO 2011/162258 A1 on Dec. 29, 2011, which claims priority to Japanese Patent Application Serial No. 2010-145633, filed Jun. 25, 2010, which applications and publication are incorporated herein by reference in their entirety.

TECHNICAL FIELD

The present invention relates to an illumination device, and more particularly to an illumination device which can be easily and sturdily assembled despite having a round or elliptical shape and which has high light utilization efficiency.

BACKGROUND ART

Over recent years, research and development of light-emitting diodes (hereinafter referred as to "LEDs") have been advancing at a rapid pace, with various types of LEDs being developed, productized, and used in a wide range of fields. Due to their features of low power consumption, long life, and compactness, LEDs have long been used as operation indicator lights for electronic equipment and the like. These LEDs have been much used in, for example, backlights for liquid crystal panels, various kinds of display boards, electronic signboards, decorative illumination devices and so forth, and have now come to be used in the field of illumination. In the illumination field, they are used for automobile headlights and taillights, in planar illumination devices incorporating a plurality of LEDs, in illumination devices that incorporate LEDs inside a tube and can be used in the same manner as fluorescent tubes, for example.

The planar light sources that are used for indoor illumination devices and the like are required to emit light uniformly, but since LEDs have strong light directionality, they are not suitable, without modification, to be used for indoor illumination devices. Accordingly, as light source devices using a related-art LED that are for obtaining illuminating light with planar, uniform illuminance distribution, light source devices in which reflection means is provided on the emitting surface of light so that the light is multiply reflected are well known (see Patent Documents 1 and 2 below). The strong-directionality light of LEDs causes unpleasant brightness called "glare" when it enters eyes directly. Light source devices that, in order to prevent this glare, are designed so that the light emitted from the light source is reflected once or more times at the sidewall of the aperture of reflection means provided inside the light source device or on its reflection surface to pass through the aperture are well known (see Patent Document 1 below).

In the light source device set forth in Patent Document 3, a point light source is provided in the bottom of a containing assembly called a casing or housing, and reflection means is provided at the mouth portion of the casing, or more precisely on the surface that faces the point light source, so that the strong-directionality light from the point light source is multiply reflected and uniformized to be emitted. In order to heighten the light utilization rate in the light source device, the casing and the reflection means have inner wall surfaces that are formed from material that has high light reflectivity, low light transmissivity, and low light absorptance. As such material, ultrafinely foamed reflection plate is used. Ultrafinely foamed reflection plate is a material that has, for example, 98% light reflectivity, and 1% each of light transmissivity and light absorptance, and is lightweight and easy to process. With this ultrafinely foamed reflection plate, the casing and reflection means, for example, can be fabricated with ease.

PATENT DOCUMENTS

[Patent Document 1] JP-A-2006-012818
[Patent Document 2] JP-A-2009 -016093
[Patent Document 3] JP-A-2009-004248 (paragraphs [0023], [0028]-[0039], FIG. 1A)

DISCLOSURE OF INVENTION

Problem to be Solved by the Invention

The ultrafinely foamed reflection plate that is used in the illumination device disclosed in Patent Document 3 has the advantage of being lightweight and easily processable, for example, easily drillable, but is difficult to thermally weld when the casing is assembled. This is because the ultrafinely foamed reflection plate is formed from plastic with thermoplasticity, and when heated, the gases contained in it are released, with the result that it shrinks or its light reflectivity lowers, and its properties change. Polyethylene terephthalate resin (hereinafter referred as to "PET") is used in the ultrafinely foamed reflection plate, and PET is generally a poor-adhesivity substance, making adhesion using an adhesive difficult.

Thus, it is easy, using ultrafinely foamed reflection plate in sheet form, to fabricate a rectangular casing by means of processing such as bending or fitting, but it has been difficult to form a casing with curved portions such as round shapes, and especially compact ones. This is because of the problem that, when the ultrafinely foamed reflection plate is curved to fabricate a cylindrical shape, it is necessary to fix the end portions mechanically because it is impossible to stick or weld the end surfaces; however, in the case of fixing by screw fastening or the like, then assembly parts with low light reflectivity will be present, and the light utilization efficiency of the illumination device will decrease, with the result that the illuminance of the illumination device as a whole will fall. Furthermore, if the ultrafinely foamed reflection plate itself is processed to provide an engaging click or other engaging structure, deformity will be prone to occur in the engaging portion and the round shape will be difficult to maintain because the ultrafinely foamed reflection plate has inherent elasticity.

It has long been practiced to fabricate separately the reflection plate, which requires precision machining, and the casing, which is easy to process, and then to fit the reflection plate into the casing and fix it using engaging structures; but with this method, engaging clicks protrude on the light-emitting surface of the reflection plate to cause unevenness, so that it has been difficult to render the device thinner. Moreover, the engaging holes are provided at a particular distance toward the interior from the end edge of the reflection plate, so that the side wall portions of the casing are tilted slightly toward the interior relative to the bottom portion, and the light utilization efficiency becomes impaired.

Accordingly, the present invention provides an illumination device with high light utilization efficiency, which can be easily and sturdily assembled even when it takes a round or elliptical shape that includes curves in the side wall portions, without any engaging structures being provided in the ultrafinely foamed reflection plate.

Means for Solving Problem

In order to achieve the object above, an illumination device of the present invention includes: a point light source; a substrate on which the point light source is mounted; a hollow frame; and a bottom surface reflection section, a side surface reflection section, and a light conducting reflection plate that are disposed inside the frame. In the illumination device, the surface of the bottom surface reflection section that faces the light conducting reflection plate, the inner surface of the side surface reflection section, and the surface of the light conducting reflection plate that faces the bottom surface reflection section are formed from members that have high light reflectivity and low light transmissivity. The frame has an opening of the same shape as the light conducting reflection plate on both sides, an engaging bent section is provided at one edge of the opening, and the side surface reflection section is disposed on the inside surface side thereof. The light conducting reflection plate is held between the engaging bent section of the frame and the side surface reflection section. The side surface reflection section is held by the other edge of the frame and the bottom surface reflection section fixed to the substrate.

In the illumination device of the invention, the bottom surface reflection section, side surface reflection section, and light conducting reflection plate each are integrally fixed to one another by fixing the substrate on which the point light source is mounted and the hollow frame, so that the structure is simple and assembly is easy. Moreover, because there is no need to provide engaging clicks or engaging holes for fixing the bottom surface reflection section, side surface reflection section, and light conducting reflection plate as in the related art cases, deformation is not likely to occur, unevenness is not likely to occur, and the light utilization efficiency is improved.

In the illumination device of the invention, it is preferable that the engaging bent section be formed by bending inward an edge of the frame.

With the illumination device of the invention, the engaging portion can be formed merely by bending inward an edge of the frame, so that there is no need to separately fabricate special dies and the frame can be fabricated at low cost and with ease, thus leading to a lower cost of the illumination device. Although there is no particular restriction on the material for the frame, it is preferable that the frame be formed from aluminum or other metallic material since this will improve fire resistance.

In the illumination device of the invention, it is preferable that the bottom surface reflection section, the light conducting reflection plate, and the side surface reflection section be given a coating constituted of a fire-retardant material.

With such aspect of the invention, even though the bottom surface reflection section, light conducting reflection plate, and side surface reflection section are formed from low heat-resistance members, the surfaces of these members can be rendered fire-retardant by being coated with a fire-retardant material, thereby enabling manufacture of a fire-resistant illumination device at low cost.

In the illumination device of the invention, it is preferable that the coating constituted of a fire-retardant material be constituted of paraxylene or polyethylene terephthalate.

Paraxylene or polyethylene terephthalate can be coated, by means of vacuum deposition or other method, onto the surfaces of large quantities of ultrafinely foamed reflection material forming at least one of the bottom surface reflection section, light conducting reflection plate, and side surface reflection section. Therefore, with this aspect of the invention, fire-retardant planar illumination devices can be mass-produced at low cost. Additionally, paraxylene, in particular, has little effect on light absorptance or other characteristics, consequently raising the fire-resistance of the illumination device and also suppressing the decline in the light utilization efficiency due to use of a diffuser plate.

In the illumination device of the invention, it is preferable that a protective plate with high light transmissivity be provided between the light conducting reflection plate and the engaging bent section.

The light conducting reflection plate has apertures or slits formed in it since it is provided in order to obtain illumination light with a uniform illuminance distribution even if a point light source such as an LED is used as the light source. With the above aspect of the invention, the light conducting reflection plate is not directly exposed to the exterior because a protective plate is provided between the light conducting reflection plate and the engaging bent section, which can prevent dirt, insects, etc., from entering into the illumination device interior, and an illumination device is obtained in which the decline in illuminance is small even in the case of being used for prolonged periods. In addition, this enables the surfaces of the illumination device to be rendered flat, so that dirt, etc., adhering to the surfaces can be removed easily. A transparent item or an item with light scattering effect can be used as the protective plate.

In the illumination device of the invention, it is preferable that a plurality of convex portions be provided in the light irradiation surface of the protective plate.

If a plurality of convex portions are provided in the light irradiation surface of the protective plate, the irradiating light is scattered in various directions. Therefore, with this aspect of the invention, the illumination range can be widened, although the illuminance does not necessarily become homogeneous.

In the illumination device of the invention, it is preferable that the plurality of convex portions be provided at equal intervals.

If the plurality of convex portions are provided at equal intervals, regularity arises in the variation of the irradiating light. Therefore, with this aspect of the invention, the illumination range can be widened without increasing the differences in illuminance within the illumination range.

In the illumination device of the invention, it is preferable that the protective plate be formed from glass.

Glass does not melt readily and does not burn, so that the fire resistance becomes raised if the protective plate is formed from glass, and furthermore, even in cases where the illumination device is installed on a ceiling surface and the light conducting reflection plate or other component inside should melt due to the heat from a fire, the melted member does not drop down, so long as the glass does not break. Thus, a high safety illumination device can be obtained.

In the illumination device of the invention, it is preferable that half-cut portions perpendicular to the bottom surface section be formed at equal intervals on the outside surface of the side surface reflection section.

In the illumination device of the invention, the frame is hollow shape, so that the side surface reflection section can readily be disposed to fit against the inner surface of the hollow frame when half-cut portions perpendicular to the bottom surface section are formed at equal intervals on the outside surface of the side surface reflection section, and thus an illumination device with a more uniform illuminance distribution can be obtained.

In the illumination device of the invention, it is preferable that the frame be provided, on the side that contacts with the substrate, with fixing means for fixing onto the substrate.

With this aspect of the invention, it is easy to fix together the frame and substrate because fixing means for fixing onto the substrate are provided on the side of the frame that contacts with the bottom surface reflection section.

In the illumination device of the invention, it is preferable that the fixing means be installed to the frame so as to be parallel to the substrate, and be fixed to the substrate by soldering.

With this aspect of the invention, the fixing means is installed to the frame so as to be parallel to the substrate, and are fixed to the substrate by soldering, so that the substrate and the fixing means can be easily and sturdily fixed together.

In the illumination device of the invention, it is preferable that the light conducting reflection plate be configured so that the light transmissivity increases and the light reflectivity decreases as the distance of the light conducting reflection plate from the point light source increases.

With this aspect of the invention, the light emitted from the point light source can be converted by the light conducting reflection plate into light with uniform illuminance over the whole plane, so that a broad range can be brightly illuminated.

In the illumination device of the invention, it is preferable that the bottom surface reflection section, the side surface reflection section, and the light conducting reflection plate be formed integrally.

With this aspect of the invention, the bottom surface reflection section, side surface reflection section, and light conducting reflection plate can be formed from the same material, so that the bottom surface reflection section, side surface reflection section, and light conducting reflection plate of the illumination device can be fabricated merely by a single punching of a large sheet of material, thus improving the manufacturing efficiency.

Furthermore, in the illumination device of the invention, it is preferable that the bottom surface reflection section, the side surface reflection section, and the light conducting reflection plate be formed from an ultrafinely foamed reflection member.

With this aspect of the invention, an ultrafinely foamed reflection plate, which has high light reflectivity and low light transmissivity, is used as the member for forming the bottom surface reflection section, side surface reflection section, and light conducting reflection plate, thus enabling the light emitted from the point light source to be utilized without loss and with high efficiency.

BEST MODES FOR CARRYING OUT THE INVENTION

Embodiments for carrying out the invention will now be described with reference to the accompanying drawings. It should be noted that these embodiments are intended as examples of illumination devices in order to carry out the technical concepts of the invention, and not as limiting the invention to these embodiments, and thus they can be equally applied to other embodiments falling within the scope and spirit of the appended claims.

Embodiment 1

Figure 1:
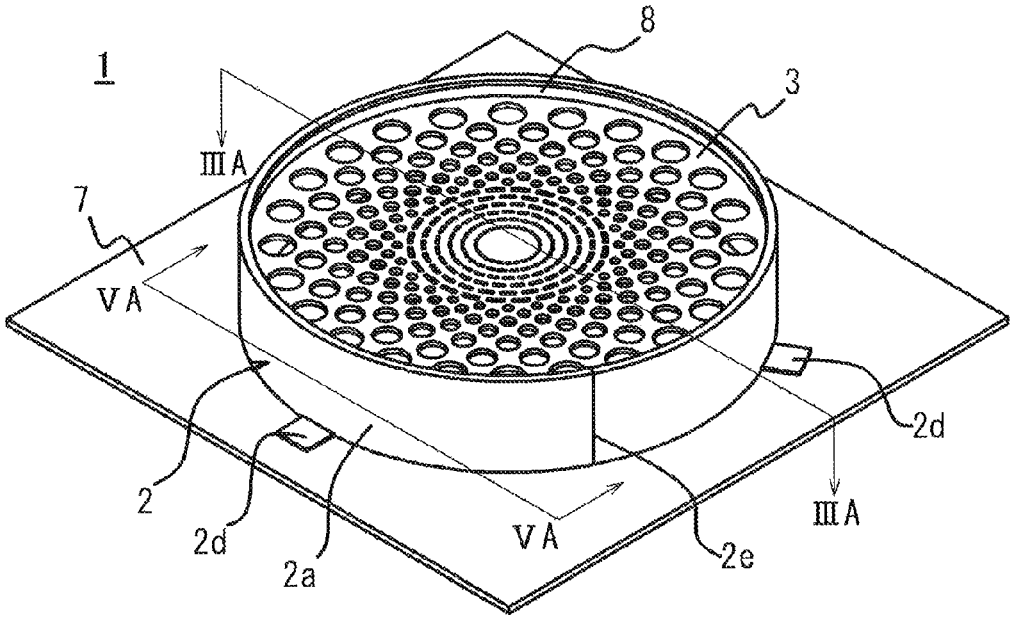
FIG. 1 is a perspective view of the illumination device in a first embodiment of the invention.
Figure 2:
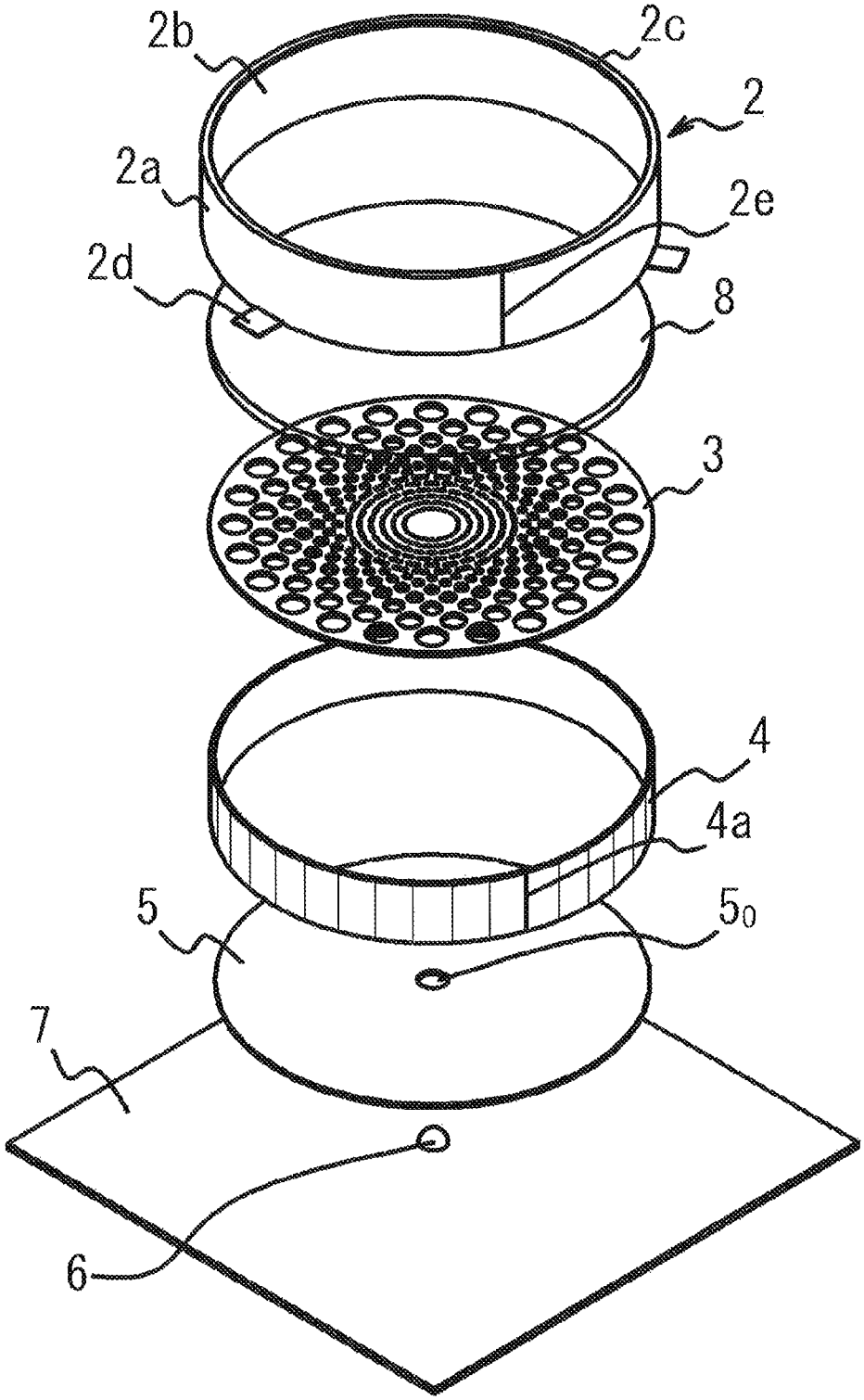
FIG. 2 is an exploded perspective view of the illumination device in FIG. 1.
Figure 3A:
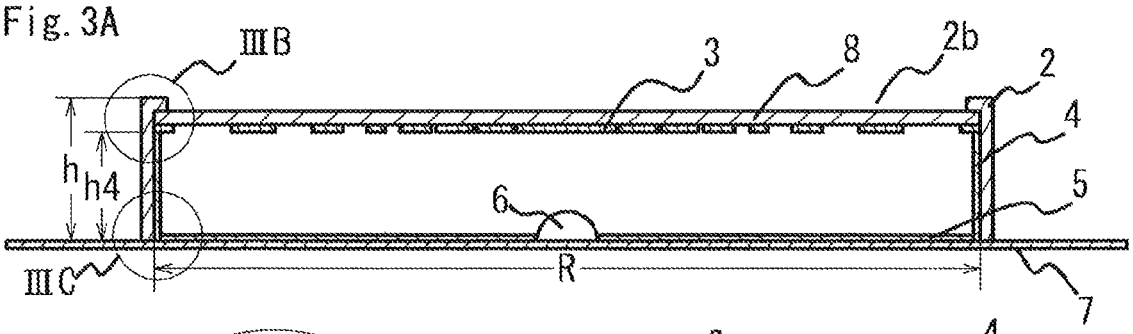
FIG. 3A is a sectional view along line IIIA-IIIA in FIG. 1.
Figure 3B:
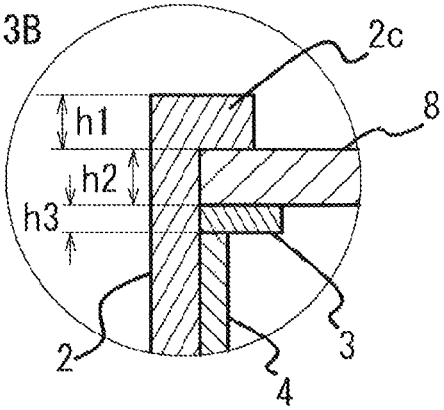
FIG. 3B is an enlarged view of portion IIIB in FIG. 3A.
Figure 3C:
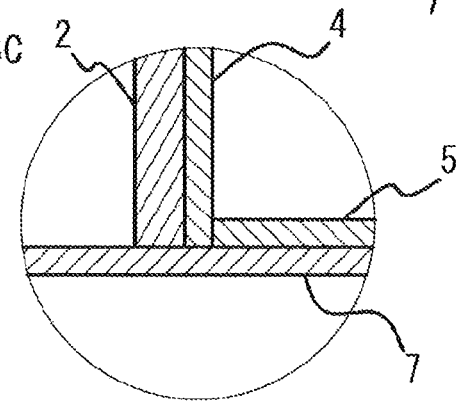
FIG. 3C is an enlarged view of portion IIIC in FIG. 3A.
Figure 4:
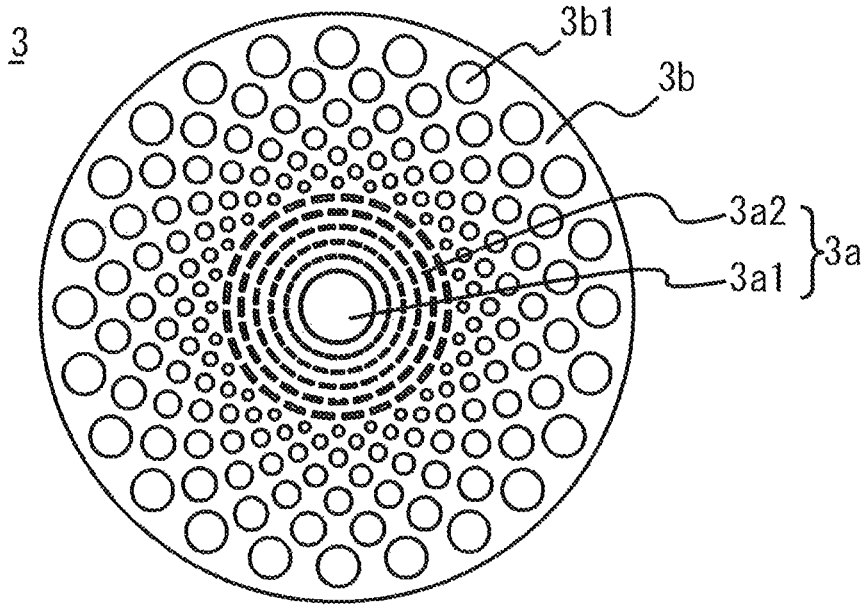
FIG. 4 is a top view of the light conducting reflection plate in the first embodiment of the invention.
Figure 5A:
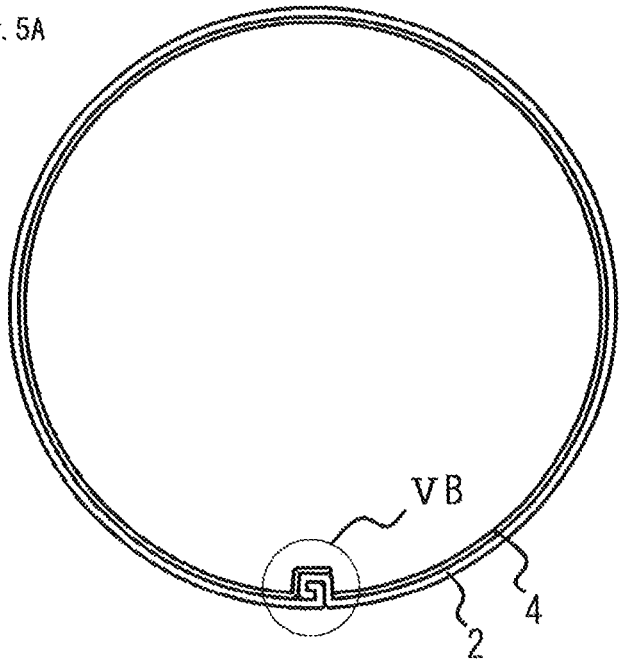
FIG. 5A is a sectional view along line VA-VA in FIG. 1.
Figure 5B:
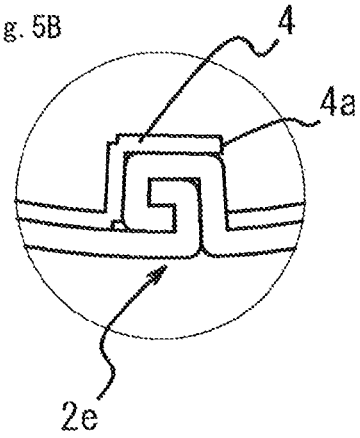
FIG. 5B is an enlarged view of portion VB in FIG. 5A.

First of all, the illumination device of Embodiment 1 of the invention will be described with reference to FIGS. 1 to 5. FIG. 1 is a perspective view of the illumination device in Embodiment 1 of the invention. FIG. 2 is an exploded perspective view of the illumination device in FIG. 1. FIG. 3A is a sectional view along line IIIA-IIIA in FIG. 1, FIG. 3B is an enlarged view of portion IIIB in FIG. 3A, and FIG. 3C is an enlarged view of portion IIIC in FIG. 3A. FIG. 4 is a top view of the light conducting reflection plate in Embodiment 1 of the invention. FIG. 5A is a sectional view along line VA-VA in FIG. 1, and FIG. 5B is an enlarged view of portion VB in FIG. 5A.

The illumination device 1 of this embodiment is assembled by providing a protective plate 8, a light conducting reflection plate 3, and a side surface reflection section 4 inside a frame 2, and installing the frame 2 to a substrate 7 to which a bottom surface reflection section 5 and a point light source 6 are fixed. The inner diameter of the light emitting surface of the illumination device 1 is, for example, 60 mm.

In this embodiment, the frame 2 is constituted of a cylindrical frame body 2*a* which has round openings 2*b* formed on both sides, and for the frame 2, a relatively low cost material such as a metallic material or synthetic resin is used. It is particularly preferable to use aluminum, or other metallic material, which is lightweight, low-cost, and highly fire-resistant, but other materials can be used. The openings 2*b* have a round shape in this embodiment, but are not limited to this shape and could have a shape that is elliptical, polygonal, indefinite (for example, star-shaped or heart-shaped), or the like.

On one side of the frame 2, an engaging bent section 2*c* bent to the inner diameter is formed so that the protective plate 8 will not fall out. On the other side, flanges 2*d* for fixing the frame 2 to the substrate 7 are formed. The protective plate 8 is inserted from the side where the flanges 2*d* are formed into the inside of the frame 2, and rests against the engaging bent section 2*c*.

The protective plate 8 has a particular thickness and is formed from acrylic sheet, glass sheet, etc. with high strength and high light transmissivity. It is possible to use an item that is transparent or an item that has light scattering effect for the protective plate 8. The protective plate 8 has a diameter almost equal to the inner diameter of the frame 2, and the item used in this embodiment has a thickness of approximately 3 mm. Particularly if a glass plate is used as the protective plate 8, the fire resistance can be raised, and furthermore, in cases where the illumination device 1 is installed on a ceiling surface, even if the light conducting reflection plate 3 on the inside melts due to the heat from a fire, the melted member does not drop down so long as the glass does not break. Thus, the safety can be raised.

Additionally, this protective plate 8 prevents dirt or insects, etc. from entering the illumination device interior, to be described later, that is formed from the light conducting reflection plate 3, side surface refection section 4, and bottom surface refection section 5, and an illumination device 1 is obtained in which the decline in illuminance is small even in the case being used for prolonged periods. In addition, the surfaces of the illumination device 1 can be rendered flat, so that dirt, etc., adhering to the surfaces can be removed easily.

The light conducting reflection plate 3 rests against the bottom surface reflection section 5 side of the protective plate 8. The light conducting reflection plate 3 has a particular thickness and is formed from material having high light reflectivity and low light transmissivity such as ultrafinely foamed reflection member. This enables the light from the point light source 6 to be reflected with high reflectivity and be utilized with good efficiency, and furthermore, a certain amount of light is transmitted also at the portion directly above the point light source 6, so that the portion directly above the point light source 6 will not be excessively dark. Since the ultrafinely foamed reflection member is easily available and at relatively low cost, the manufacture costs can be curbed. As shown in FIG. 4, the light conducting reflection plate 3 includes a central light conducting reflection plate section 3*a* at the portion directly above the point light source 6, and an outer light conducting reflection plate section 3*b* around the central light conducting reflection plate section 3*a*.

A central portion 3*a*1 is provided in the central part of the central light conducting reflection plate section 3*a*, that is, at the portion directly above the point light source 6. The central portion 3*a*1 is formed to have high light reflectivity and reflects the intense light emitted from the point light source 6; this reflected light is further multiply reflected by the side surface refection section 4, bottom surface refection section 5, and light conducting reflection plate 3. The reflectivity of the central portion 3*a*1 is determined as appropriate depending on selection of material of light reflection plate and processing (for example, formation of half-slits and adjustment of the sheet thickness) of such material, thereby the light can be utilized with good efficiency. A peripheral portion 3*a*2 is provided around the periphery of the central portion 3*a*1, that is, at the boundary with the outer light conducting reflection plate section 3*b*. The peripheral portion 3*a*2 has arc-shaped slits and is designed to have the second highest light reflectivity after to the central portion 3*a*1, but on the other hand to allow part of the light to pass through. Due to the use of slits, while having a certain light transmissivity, the light emitted from the point light source does not directly pass through the light conducting reflection plate. These slits can alternatively be small holes or the like.

In the outer light conducting reflection plate section 3*b*, round apertures 3*b*1 are formed at particular intervals. The diameter of the apertures 3*b*1 increases steadily with a larger distance outward from the central light conducting reflection plate section. Additionally, the slits and the apertures 3*b*1 are designed so as to conduct the light that is emitted from the point light source 6 and reflected once or more times by the side surface refection section 4, bottom surface refection section 5, and light conducting reflection plate 3. Instead of round apertures, slits in a concentric ring-form or rectangular form can be provided, with their width increasing with a larger distance outward from the central light conducting reflection plate section 3*a*. By disposing the light conducting reflection plate 3 having a structure as described above so as to face the point light source 6, a uniform illuminance distribution can be obtained even if an LED with strong light directionality is used as the light source.

The side surface reflection section 4, which is curved so as to fit against the inner wall of the frame 2, is disposed into the frame 2, to which the light conducting reflection plate 3 has been inserted. Like the light conducting reflection plate 3, the side surface reflection section 4 has a particular thickness is formed from material with high light reflectivity and low light transmissivity such as ultrafinely foamed reflection member, and also has a length almost equal to the inner periphery of the frame 2, and a height h4 equal to the height h of the frame 2 minus the thickness h1 of the engaging bent section 2*c*, the thickness h2 of the protective plate, and the thickness h3 of the light conducting reflection plate 3.

Unless processing of some kind is performed when the side surface reflection section 4 is curved and made to fit against the inside of the frame 2, the end portion 4*a* of the side surface reflection section will be slightly loose from the frame 2 and takes on what may be termed a droplet shape, so that it will not be possible to reflect the light uniformly. To prevent the end portion 4*a* from being loose from the frame 2, half-cut machining is performed at equal intervals on the outside of the side surface reflection section 4 before bending it, thereby the side surface reflection section 4 is formed into a regular polygonal shape, viewed in the light shining direction. In this embodiment, the half-cut machining is performed at intervals of 3 mm. The intervals of the portions of half-cut machining are preferable to be narrower because the regular polygonal shape will further approximate to a circle. However, the purpose can be achieved if the half-cut intervals are about 5 mm.

When the plate material is rolled to make the cylindrical form of the frame 2, the two end portions may be superposed and bent toward the inner wall, forming a joint portion 2*e*. With such joint portion 2*e*, the side surface reflection section 4 also may become loose at this part. In order to prevent this, preferably the side surface reflection section 4, with one end portion 4*a* placed in a position corresponding to a side surface of the joint portion 2*e*, will be laid in contact against the frame 2 all around the inner wall, then the portion that overlies the joint portion 2*e* will be half-cut machined in at least two places and formed by bending into a shape that fits against the joint portion 2*e*.

Note that in the state with the side surface reflection section 4 disposed on the frame 2, the light conducting reflection plate 3 and side surface reflection section 4 have not yet been fixed to the frame 2; the fixing of these is carried out via installation of the frame 2 to the substrate 7 as described below.

A point light source 6 is installed at the center of the substrate 7 and is connected to a power source through a connector or other items (not shown in the drawings). Although the substrate 7 is rectangular in this embodiment, it can alternatively be circular or some other shape. The point light source 6 is an LED that has one light-emitting element or a plurality of light-emitting elements, but a laser diode or the like can be used instead of an LED.

After installation of the point light source 6, the bottom surface reflection section 5 is installed to the substrate 7 in advance by means of double-sided adhesive tape or the like. Like the light conducting reflection plate 3 and the side surface reflection section 4, the bottom surface reflection section 5 has a particular thickness, is formed from material with high light reflectivity and low light transmissivity such as ultrafinely foamed reflection member, and has a round shape that contacts internally against the polygonally formed side surface reflection section 4. Additionally, a hole $\mathbf{5}_0$ for allowing the point light source 6 to pass through is provided at the center of the bottom surface reflection section 5.

The frame 2, with the protective plate 8, light conducting reflection plate 3, and side surface reflection section 4 disposed thereon, is disposed onto the substrate 7 so that the bottom surface reflection section 5 contacts internally with the side surface reflection section 4. The height h4 of the side surface reflection section 4 is the height h of the frame 2 minus the thickness h1 of the engaging bent section 2*c*, the thickness h2 of the protective plate, and the thickness h3 of the light conducting reflection plate 3, and since the bottom surface reflection section 5 is designed to contact internally with the side surface reflection section 4, fixing can be effected without any gaps occurring between the frame 2, light conducting reflection plate 3, side surface reflection section 4, and bottom surface reflection section 5.

The frame 2 is fixed by soldering the flanges 2*d* to the substrate 7. The point light source 6, etc., is usually fixed to the substrate 7 by soldering, and the frame 2 also can be fixed easily and sturdily by soldering. In other cases, where the flanges 2*d* of the frame 2 are formed from a material that cannot be soldered, it is possible to effect fixing by providing the substrate 7 with slits in order to allow the flanges 2*d* to be inserted therethrough so that the flanges 2*d* will be inserted through the slits to be bent onto the inner surface.

Note that although a protective plate 8 is disposed between the frame 2 and the light conducting reflection plate 3 in this embodiment, the light conducting reflection plate 3 can be provided directly on the frame 2 without disposing a protective plate 8.

Figure 6:
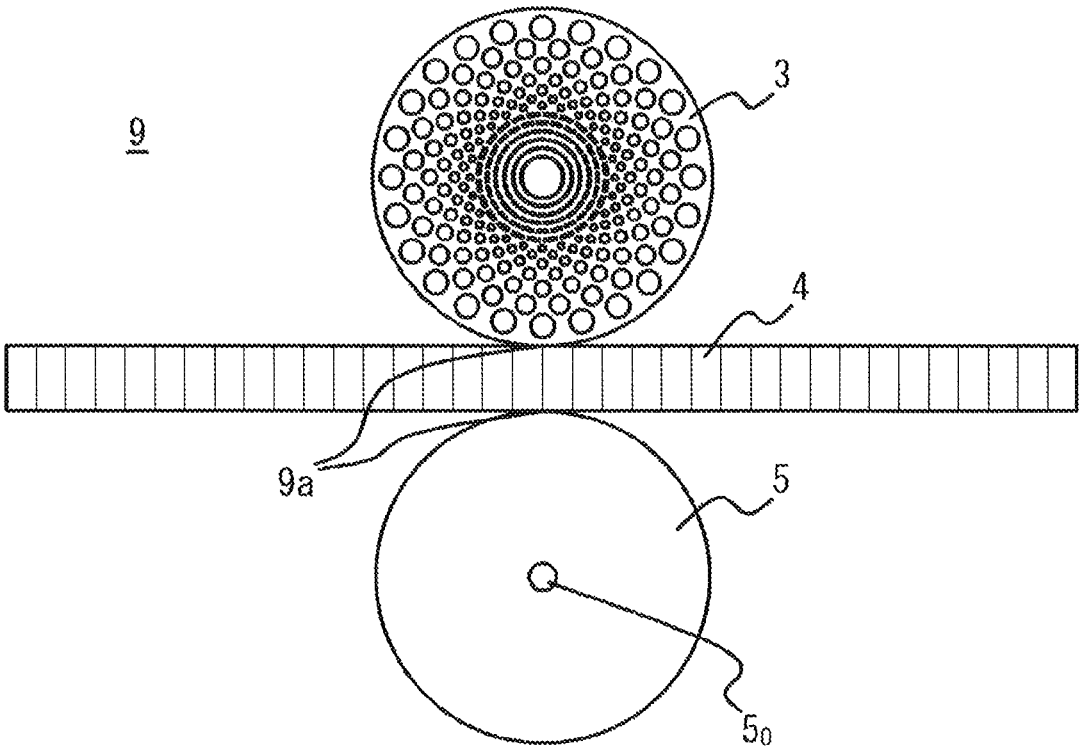
FIG. 6 is an opened-up view of a reflection section forming member in another embodiment of the invention.

Although in this embodiment an example has been set forth where the light conducting reflection plate 3, side surface reflection section 4, and bottom surface reflection section 5 are formed separately, they can be formed integrally from a single ultrafinely foamed reflection member. FIG. 6 is an opened-up view of a reflection section formed member 9 in which the light conducting reflection plate 3, side surface reflection section 4, and bottom surface reflection section 5 are formed integrally. In this reflection section formed member 9, the light conducting reflection plate 3 is formed at one long edge of the side surface reflection section 4 and the bottom surface reflection section 5 at the other. The light conducting reflection plate 3 and the bottom surface reflection section 5 are not completely cut off from the side surface reflection section 4, but are joined via bent portions 9*a*. Half-cut machining is performed on the surfaces of the bent portions 9*a* opposite to the direction of bending, and when the conducting reflection plate 3 and the bottom surface reflection section 5 are bent perpendicularly to stand up from the side surface reflection section 4, the half-cut portions in the bent portions 9*a* opens up, which leads to easy bending.

Embodiment 2

Figure 7A:
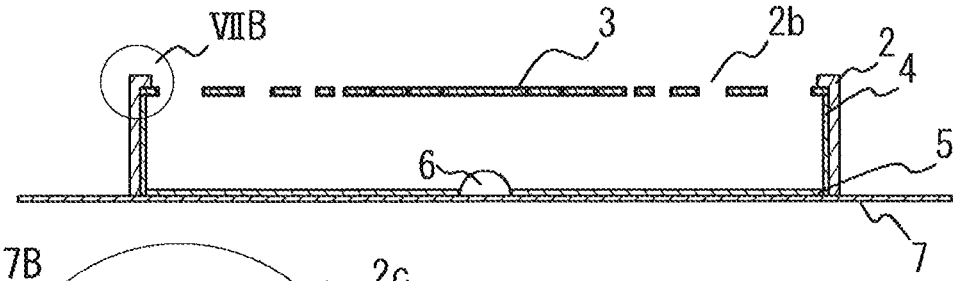
FIG. 7A is a sectional view of the illumination device in a second embodiment of the invention.
Figure 7B:
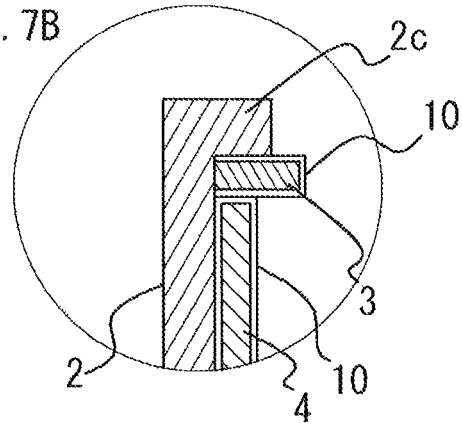
FIG. 7B is an enlarged view of portion VIIB in FIG. 7A.
Figure 8:
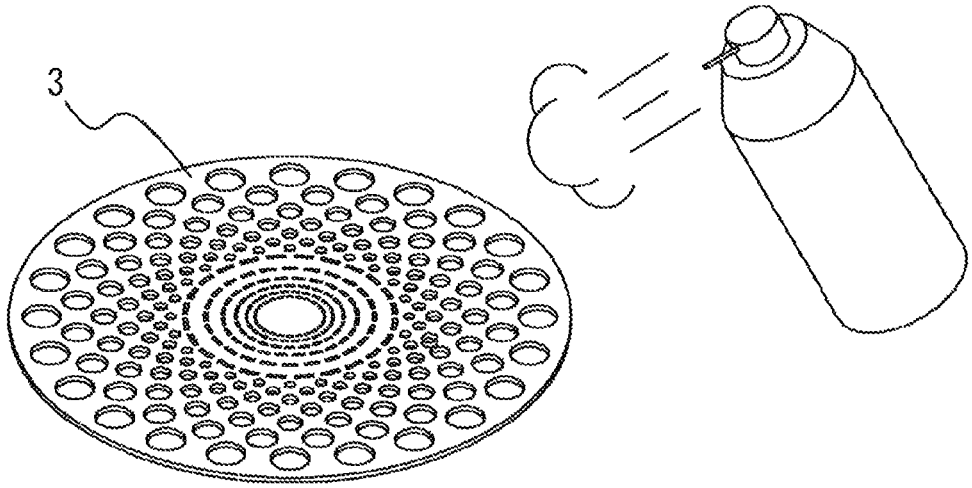
FIG. 8 is a schematic illustrating an example of fire retardance processing on the light conducting reflection plate in FIG. 7.
Figure 9:
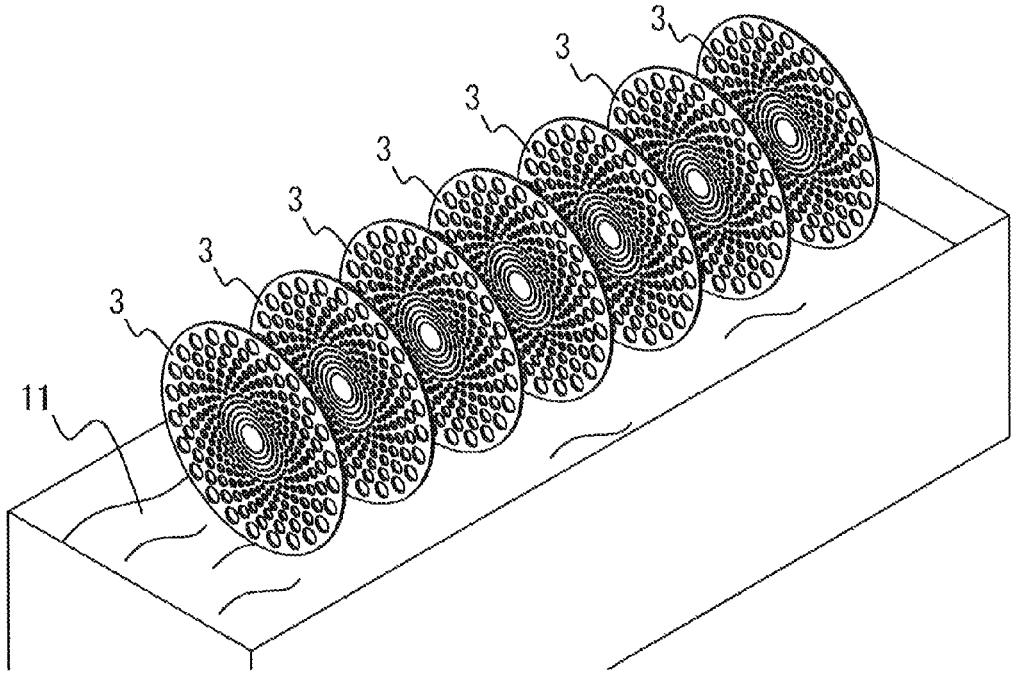
FIG. 9 is a schematic illustrating another example of fire retardance processing on the light conducting reflection plate in FIG. 7.

Next, an illumination device of Embodiment 2 of the invention will be described with reference to FIGS. 7 to 9. FIG. 7A is a sectional view of the illumination device in Embodiment 2 of the invention, and FIG. 7B is an enlarged view of portion VIIB in FIG. 7A. FIG. 8 is a schematic illustrating an example of fire retardance processing on the light conducting reflection plate in FIG. 7. FIG. 9 is a schematic illustrating another example of fire retardance processing on the light conducting reflection plate in FIG. 7.

The illumination device of Embodiment 2 has the structure of the illumination device of Embodiment 1 with partial alterations. Note that in the following description, those structural components that are shared with the illumination device of Embodiment 1 are assigned the same reference numerals and descriptions thereof are omitted as redundant, while the structural components that differ will be described in detail.

The illumination device of Embodiment 2 differs from that of Embodiment 1 in that, as shown in FIG. 7A, a protective plate is not provided and the light conducting reflection plate 3, side surface reflection section 4, and bottom surface reflection section 5 themselves are processed to be fire-retardant. FIG. 7B, which is an enlarged view of portion VIIB in FIG. 7A, shows that a coating layer 10 constituted of fire-retardant material is formed on the peripheries of the light conducting reflection plate 3 and side surface reflection section 4. Likewise, the bottom surface reflection section 5 is provided with the coating layer 10 constituted of fire-retardant material. This processing is carried out via application of publicly known fire-retardant material such as boric acid compound to both sides of the light conducting reflection plate 3 with spray as shown in FIG. 8, or via immersion of the light conducting reflection plate 3 into a liquid fire-retardant material 11 as shown in FIG. 9. Note that, although not shown in the drawings, processing on the side surface reflection section 4 and bottom surface reflection section 5 is carried out in the same manner. By thus coating, with a fire-retardant material 11, the light conducting reflection plate 3, side surface reflection section 4, and bottom surface reflection section 5 that are formed from ultrafinely foamed reflection material with low heat resistance to make the components fire-retardant, a fire-resistant illumination device can be manufactured at low cost.

The peripheries of the light conducting reflection plate 3, side surface reflection section 4, and bottom surface reflection section 5 can be coated with a fire-retardant resin such as paraxylene resin or polyethylene terephthalate, which are publicly known as fire-retardant material, by means of vacuum deposition or the like. It is particularly preferable that paraxylene be used since it has little effect on light absorptance or other characteristics. The vacuum deposition method can process the light conducting reflection plate 3, side surface reflection section 4, and bottom surface reflection section 5 in large quantities, and hence is suitable for mass production of the illumination device. By raising the fire retardance of the light conducting reflection plate 3, side surface reflection section 4, and bottom surface reflection section 5 in this way, the fire resistance of the illumination device of this embodiment is raised, and moreover, the decline in the light utilization efficiency due to use of a protective plate is suppressed while at the same time the manufacture cost of the illumination device is kept low. Furthermore, instead of coating with fire-retardant resin, the light conducting reflection plate, side surface reflection section, and bottom surface reflection section can be formed using polycarbonate resin, which is a high fire-retardance material, although it lowers the light reflectivity. As another alternative, the surface of the light conducting reflection plate constituted of a foam of polyethylene, polyolefin, polypropylene or the like can be coated with ceramic powder, titanium white, pure silver coating provided with an antioxidant film, or the like.

Embodiment 3

Next, an illumination device of Embodiment 3 of the invention will be described with reference to FIGS. 10 and 11. FIG.

Figure 10A:
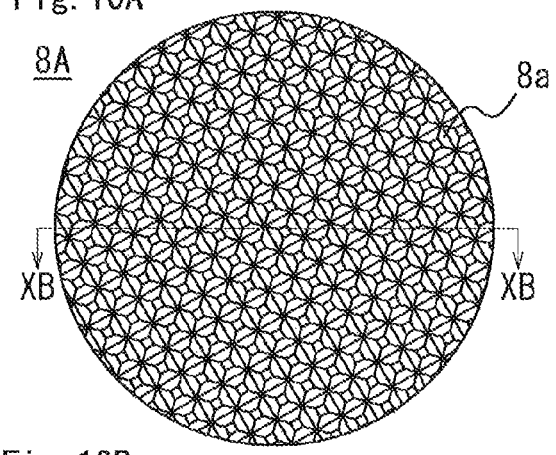
FIG. 10A is a top view of a diffuser plate used in the illumination device of a third embodiment of the invention.
Figure 10C:
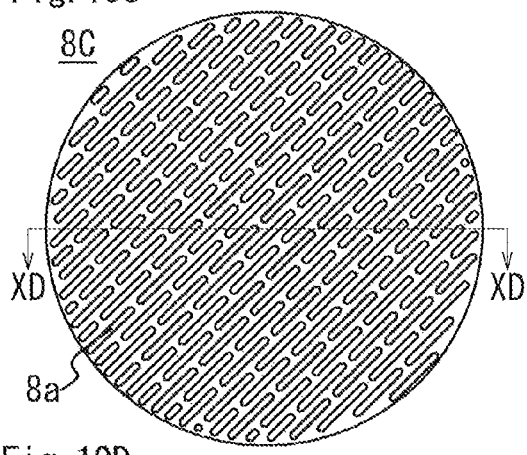
FIG. 10C is another example of a top view of a diffuser plate used in the illumination device of the third embodiment of the invention.
Figure 10B:
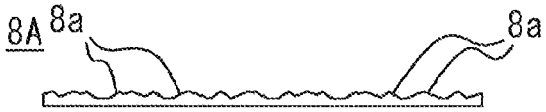
FIG. 10B is a sectional view along line XB-XB in FIG. 10A.
Figure 10D:
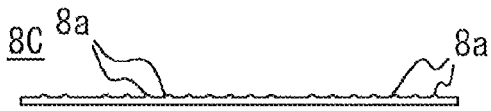
FIG. 10D is a sectional view along line XD-XD in FIG. 10C.

10A is a top view of a diffuser plate used in the illumination device of Embodiment 3 of the invention, FIG. 10B is a sectional view along line XB-XB in FIG. 10A, FIG. 10C is another example of a top view of a diffuser plate used in the illumination device of Embodiment 3 of the invention, and FIG. 10D is a cross-sectional view along line XD-XD in FIG. 10C. FIG. 11 is a perspective view of the illumination device of Embodiment 3 of the invention.

The illumination device of Embodiment 3 has the structure of the illumination device of Embodiment 1 with partial alterations. Note that in the following description, those structural components that are shared with the illumination device of Embodiment 1 are assigned the same reference numerals and descriptions thereof are omitted as redundant, while the structural components that differ will be described in detail.

Figure 11:
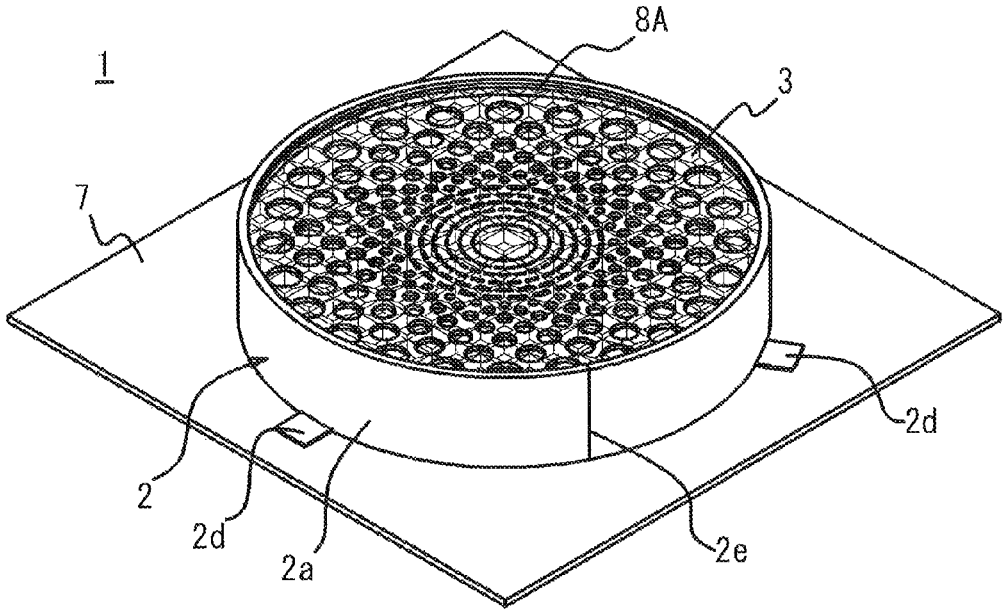
FIG. 11 is a perspective view of the illumination device of the third embodiment of the invention.

In the illumination device of Embodiment 3 of the invention, a diffuser plate that includes a plurality of convex portions 8*a* on the light irradiation surface is used as the protective plate 8A, as shown in FIGS. 10A, 10B, and 11. In this embodiment, the convex portions are a lattice pattern of triangular prisms disposed at intervals of 3 mm, with the maximum height of 1 mm. The maximum height of the convex portions is preferable to be from one half to one third or so of the thickness of the protective plate 8A.

By providing the protective plate 8A with the convex portions 8*a*, the light emitted from the light conducting reflection plate 3 can be scattered, widening the illumination range. Instead of a lattice pattern, the convex portions 8*a* can be disposed in parallel in one direction only, as in the protective plate 8C illustrated in FIGS. 10C and 10D. Additionally, although not shown in the drawings, the convex portions can be disposed randomly. By altering the disposition of the convex portions, the directions in which the light emitted from the light conducting reflection plate 3 is scattered can be varied, and thereby the illumination range or the irradiation direction can be modified.

EXPLANATIONS OF LETTERS OR NUMERALS

1 Illumination device
2 Frame
3 Light conducting reflection plate
4 Side surface reflection section
5 Bottom surface reflection section
6 Point light source
7 Substrate
8 Protective plate
9 Reflection section forming member
10 Coating layer
11 Fire-retardant material

The invention claimed is:

1. An illumination device comprising:
a point light source;
a substrate on which the point light source is mounted;
a hollow frame; and
a bottom surface reflection section, a side surface reflection section, and a light conducting reflection plate that are disposed inside the frame,
the surface of the bottom surface reflection section that faces the light conducting reflection plate, the inner surface of the side surface reflection section, and the surface of the light conducting reflection plate that faces the bottom surface reflection section being formed from members that have high light reflectivity and low light transmissivity,
the frame having an opening of the same shape as the light conducting reflection plate on both sides, an engaging bent section being provided at one edge of the opening, and the side surface reflection section being disposed on the inside surface side thereof,
the light conducting reflection plate being held between the engaging bent section of the frame and the side surface reflection section; and
the side surface reflection section being held by the other edge of the frame and the bottom surface reflection section fixed to the substrate.

2. The illumination device according to claim 1, wherein the engaging bent section of the frame is formed by bending inward an edge of the frame.

3. The illumination device according to claim 1, wherein the bottom surface reflection section, the light conducting reflection plate, and the side surface reflection section are given a coating constituted of a fire-retardant material.

4. The illumination device according to claim 3, wherein the coating constituted of a fire-retardant material is constituted of paraxylene or polyethylene terephthalate.

5. The illumination device according to claim 1, wherein a protective plate with high light transmissivity is provided between the light conducting reflection plate and the engaging bent section of the frame.

6. The illumination device according to claim 5, wherein a plurality of convex portions are provided in the light irradiation surface of the protective plate.

7. The illumination device according to claim 6, wherein the plurality of convex portions are provided at equal intervals.

8. The illumination device according to claim 5, wherein the protective plate is formed from glass.

9. The illumination device according to claim 1, wherein half-cut portions perpendicular to the bottom surface section are formed at equal intervals on the outside surface of the side surface reflection section.

10. The illumination device according to claim 1, wherein the frame is provided, on the side that contacts with the substrate, with fixing means for fixing onto the substrate.

11. The illumination device according to claim 10, wherein the fixing means is installed to the frame so as to be parallel to the substrate, and is fixed to the substrate by soldering.

12. The illumination device according to claim 1, wherein the light conducting reflection plate is configured so that the light transmissivity increases and the light reflectivity decreases as the distance of the light conducting reflection plate from the point light source increases.

13. The illumination device according to claim 1, wherein the bottom surface reflection section, the side surface reflection section, and the light conducting reflection plate are formed integrally.

14. The illumination device according to claim 1, wherein the bottom surface reflection section, the side surface reflection section, and the light conducting reflection plate are formed from an ultrafinely foamed reflection member.

* * * * *